US010053897B1

(12) United States Patent
Hauber

(10) Patent No.: US 10,053,897 B1
(45) Date of Patent: Aug. 21, 2018

(54) MULTI-POINT SLIDING DOOR LATCH

(71) Applicant: Peter Hauber, Buellton, CA (US)

(72) Inventor: Peter Hauber, Buellton, CA (US)

( * ) Notice: Subject to any disclaimer, the term of this patent is extended or adjusted under 35 U.S.C. 154(b) by 106 days.

(21) Appl. No.: 14/559,900

(22) Filed: Dec. 3, 2014

Related U.S. Application Data

(63) Continuation of application No. 13/065,499, filed on Mar. 22, 2011, now Pat. No. 8,931,812.

(51) Int. Cl.
*E05C 9/16* (2006.01)
*E05C 19/12* (2006.01)
*E05C 9/00* (2006.01)

(52) U.S. Cl.
CPC ..... *E05C 19/12* (2013.01)

(58) Field of Classification Search
CPC ... E05C 19/12; E05C 9/10; E05C 9/12; E05C 9/16
See application file for complete search history.

(56) References Cited

U.S. PATENT DOCUMENTS 479,104 A * 7/1892 Fleischel et al. ... E05B 65/0811 292/27
1,716,113 A * 6/1929 Carlson ..... B60C 27/10 24/68 TT
1,892,512 A * 12/1932 Kemp ..... E05B 63/126 292/142
1,900,503 A * 3/1933 Kemp ..... E05B 63/126 292/33
1,908,980 A * 5/1933 Heyel ..... E05B 63/126 292/34
2,701,156 A * 2/1955 Palmer, Jr. ..... E05B 65/0817 292/113
2,739,002 A * 3/1956 Johnson ..... H01H 9/22 220/3.8
3,105,711 A * 10/1963 Woodworth ..... E05B 65/0817 292/113
3,162,472 A * 12/1964 Rust ..... E05B 65/0811 292/114
3,400,562 A * 9/1968 Bloss ..... E05B 65/5238 292/118
3,413,025 A * 11/1968 Sperry ..... E05B 65/0817 292/111
3,437,364 A * 4/1969 Walters ..... E05B 65/0817 292/106
3,586,360 A * 6/1971 Perrotta ..... E05C 9/043 292/111
3,899,201 A * 8/1975 Paioletti ..... E05B 65/0858 292/106
3,904,229 A * 9/1975 Waldo ..... E05B 65/087 292/103
4,076,289 A * 2/1978 Follows ..... E05B 65/0811 292/226

(Continued)

*Primary Examiner* — Alyson M Merlino
(74) *Attorney, Agent, or Firm* — D. Whitlow Bivens; Musick, Peeler & Garrett, LLP

(57) ABSTRACT

A multi-point sliding door latch intended to fit within standard sized opening in the stile of a sliding door. Preferably the latch has at least two hooks oriented in opposite directions that slide in a generally linear manner between an unlatched and latched position in response to rotation of a pair of actuators located within the latch housing. Preferably, the latch includes reinforcement blocks defining cavities with a portion of the hooks extending into the cavities when the hooks are in the latched position.

2 Claims, 8 Drawing Sheets

(56) References Cited

U.S. PATENT DOCUMENTS 4,116,479 A * 9/1978 Poe ..... E05C 19/145 292/113
4,132,438 A * 1/1979 Guymer ..... E05B 65/0811 292/111
4,602,812 A * 7/1986 Bourne ..... E05C 19/145 292/113
4,643,005 A * 2/1987 Logas ..... E05C 9/026 292/20
4,961,602 A * 10/1990 Pettersson ..... E05B 65/087 292/97
4,973,091 A * 11/1990 Paulson ..... E05C 9/041 292/216
5,092,144 A * 3/1992 Fleming ..... E05B 65/0811 292/244
5,118,151 A * 6/1992 Nicholas, Jr. ..... E05B 15/0245 29/437
5,125,703 A * 6/1992 Clancy ..... E05B 63/0056 292/1.5
5,171,050 A * 12/1992 Mascotte ..... E05B 15/025 292/340
5,722,704 A * 3/1998 Chaput ..... E05B 65/0811 292/26
5,791,700 A * 8/1998 Biro ..... E05C 9/043 292/36
5,820,170 A * 10/1998 Clancy ..... E05B 65/0858 292/123
5,906,403 A * 5/1999 Bestler ..... E05B 65/087 292/117
5,951,068 A * 9/1999 Strong ..... E05B 65/0858 292/112
6,094,869 A * 8/2000 Magoon ..... E05B 9/002 49/460
D433,916 S * 11/2000 Frey ..... D8/302
6,264,252 B1 * 7/2001 Clancy ..... E05B 65/0858 292/123
6,282,929 B1 * 9/2001 Eller ..... E05C 9/02 292/32
6,502,435 B2 * 1/2003 Watts ..... E05B 63/20 292/336.3
6,637,784 B1 * 10/2003 Hauber ..... E05B 63/242 292/300
6,663,147 B1 * 12/2003 Alban ..... E05C 9/1841 292/27
6,672,632 B1 * 1/2004 Speed ..... E05B 65/0858 292/11
6,688,656 B1 * 2/2004 Becken ..... E05B 65/0858 292/26
6,733,051 B1 * 5/2004 Cowper ..... E05B 63/242 292/192
6,776,441 B2 * 8/2004 Liu ..... E05B 63/0013 292/24
6,981,724 B2 * 1/2006 Denys ..... E05B 63/24 292/64
7,040,671 B2 * 5/2006 Su ..... E05B 63/0013 292/116
7,178,839 B2 * 2/2007 Tsai ..... E05B 65/0858 292/112
7,497,103 B1 * 3/2009 Misner ..... E05B 63/14 292/129
7,604,265 B2 * 10/2009 Tsai ..... E05B 65/0858 292/116
8,931,812 B1 * 1/2015 Hauber ..... E05B 15/0053 292/24
2006/0071478 A1 * 4/2006 Denys ..... E05B 63/12 292/26
2006/0076783 A1 * 4/2006 Tsai ..... E05B 15/024 292/24

* cited by examiner

FIG. 1
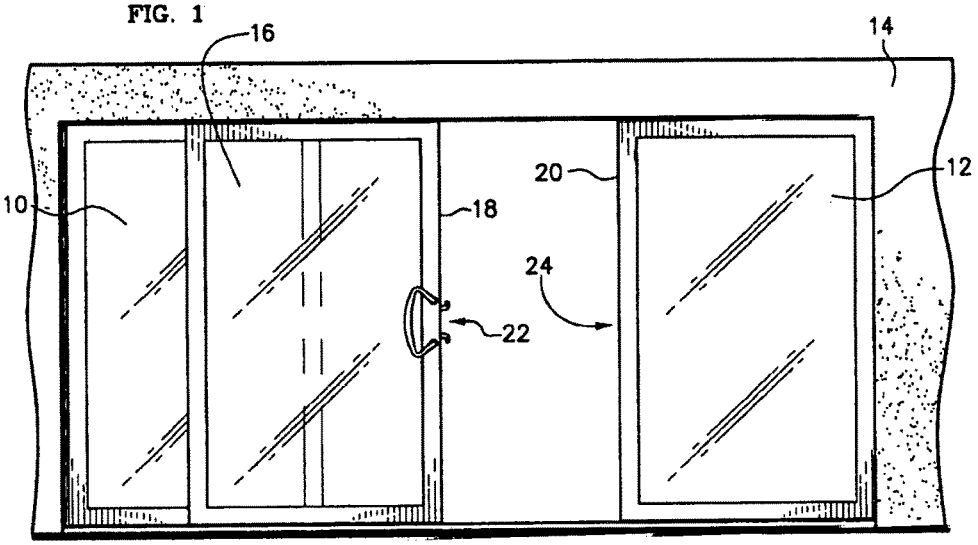
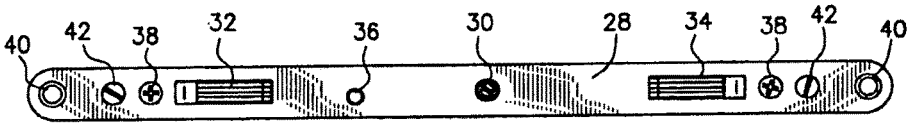
FIG. 2
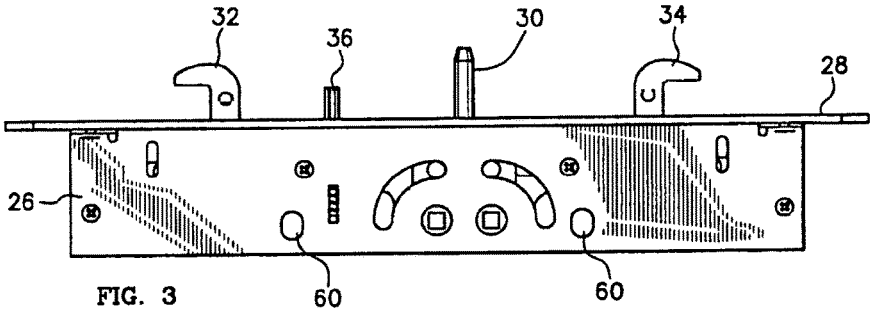
FIG. 3
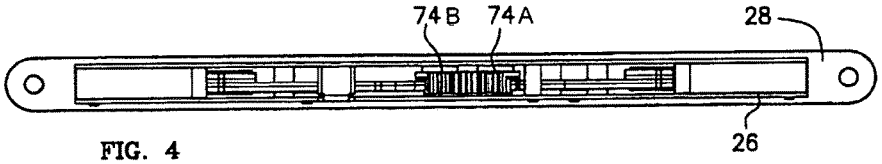
FIG. 4

FIG. 5
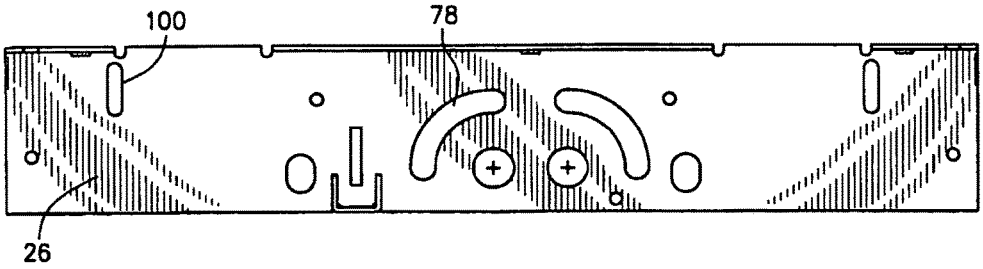
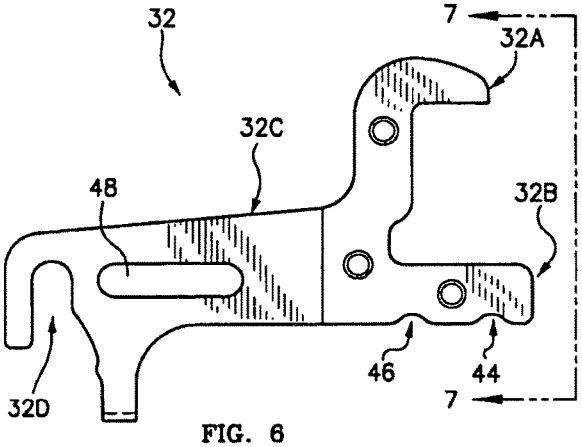
FIG. 6
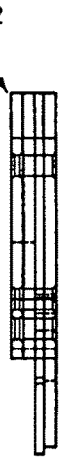
FIG. 7
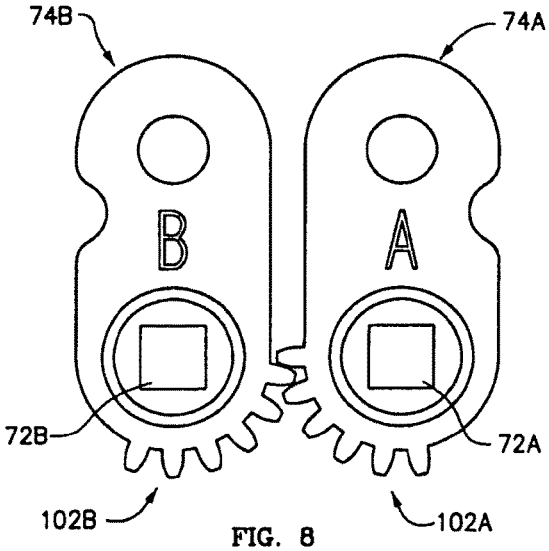
FIG. 8
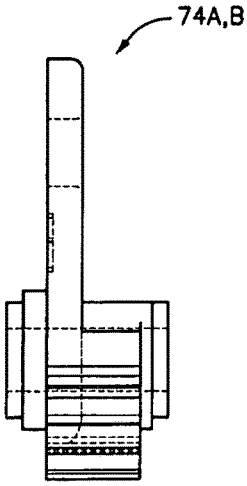
FIG. 9

MULTI-POINT SLIDING DOOR LATCH

CROSS-REFERENCE TO RELATED APPLICATIONS

This is application is a continuation application and claims the benefit of application Ser. No. 13/065,499 filed Mar. 22, 2011.

BACKGROUND OF THE INVENTION

The present invention relates to multi-point door latches and more particularly to a multi-point door latch particularly suitable for use with sliding doors.

There remains a need for sliding door locks with increased strength and multiple connection points between the sliding door and the corresponding door jamb. The increased strength and multiple connection points reduce the chance of a successful forced entry and allow the lock to be used with relatively heavy doors and in other applications in which the lock may be placed under relatively high tension.

A standard sliding door installation, such as a sliding glass door, typically includes a latch or lock mounted in the face of the stile of the sliding door. Most such locks have a single hook or latching element that interacts with a keeper plate on the corresponding door jamb. A lock with two hooks or latches provides at least two advantages over a lock with a single hook. First, the lock with two connection points can be constructed to withstand higher forces. Second, if the two hooks are oriented in opposite directions, it precludes the possibility of tilting or lifting the door to disengage the hooks from the keeper plate and thus defeat the lock. Many multi-point sliding door locks are complex, relatively expensive and require substantial modification of the stile of the sliding door during installation of the lock. Thus, there remains a need for a simple, strong, relatively inexpensive and easy to install multi-point sliding door lock.

Most sliding door locks employ a rotating or pivoting hook as the attachment point between the sliding door and the keeper plate. The hook rotates between an unlocked position in which it is within the housing of the door lock and a locked position in which it rotates out of the housing to engage the keeper plate. Locks based on a sliding engagement mechanism may be constructed to be stronger than locks based on a rotating mechanism. It is believed that a multiple point door lock based on a sliding engagement mechanism and adapted to fit into the standard opening of a sliding door stile are not known in the art.

SUMMARY OF THE INVENTION

The present invention provides a lock particularly adapted for increased security against forced entry and heavy doors. The lock provides two points of attachment between the lock and the keeper plate. The attachment means slide rather than rotate allowing for very strong reinforcement of the attachment means which, in turn, allows for a very strong attachment between the lock and the keeper plate. Such strength minimizes the chances of a forced entry accomplished through failure of the lock. Preferably, the attachment means are hooks oriented in opposite directions. Such orientation eliminates the possibility of gaining entry by lifting the hooks out of the opening in the keeper plate by tilting or lifting the door.

Preferably, the lock is sized to fit into standard size openings for receiving locks in the stile of a sliding door. The latch may also be provided with a mechanism to prevent the latch from being placed into the locked position unless the sliding door is closed against the opposing jamb.

BRIEF DESCRIPTION OF THE DRAWINGS

FIG. 1 is a side view of a typical patio door installation;

FIG. 2 is a front view of one embodiment of the invention;

FIG. 3 is a side view of one embodiment of the invention;

FIG. 4 is a bottom view of one embodiment of the invention;

FIG. 5 is a side view of the outer casing of one embodiment of the invention;

FIG. 6 is a side view of a hook of one embodiment of the invention;

FIG. 7 is an end view of a hook of one embodiment of the invention;

FIG. 8 is a plan view of two actuators of one embodiment of the invention;

FIG. 9 is an end view of an actuator of one embodiment of the invention;

DETAILED DESCRIPTION OF THE PREFERRED EMBODIMENT

Figure 10:
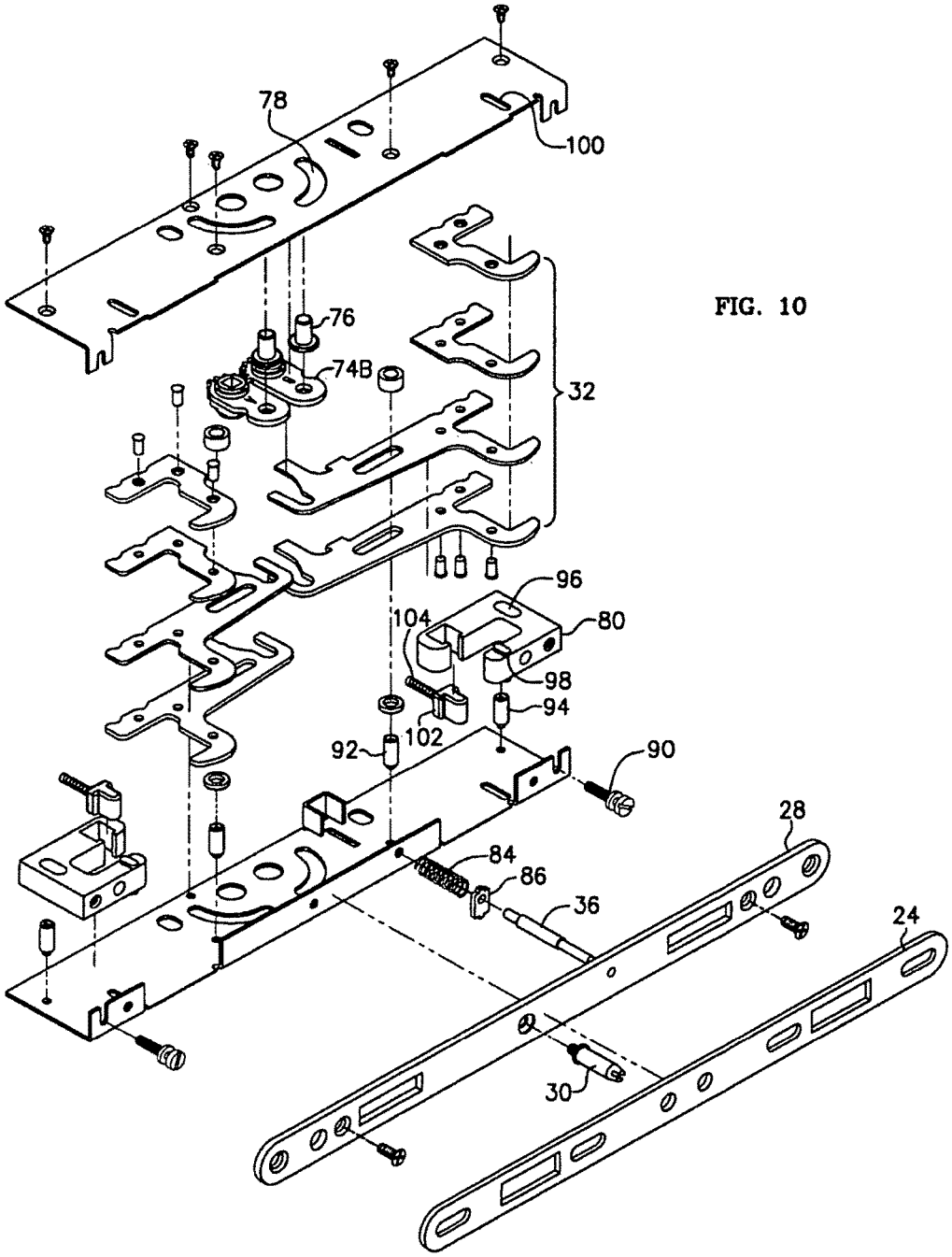
FIG. 10 is an exploded perspective view of one embodiment of the invention.

The following description relates only to a preferred embodiment of the invention. The specific features described below do not limit the scope of the invention.

FIG. 1 shows a typical arrangement for a sliding patio door. Doors 10 and 12 are fixed within an opening in wall 14. Door 16 slides between the open position shown and a closed position in which stile 18 abuts jamb 20. In the closed position, latch 22 within stile 18 contacts keeper plate 24 on jamb 20. Preferably, latch 22 is sized to fit within a standard size opening in stile 18.

Figure 11:
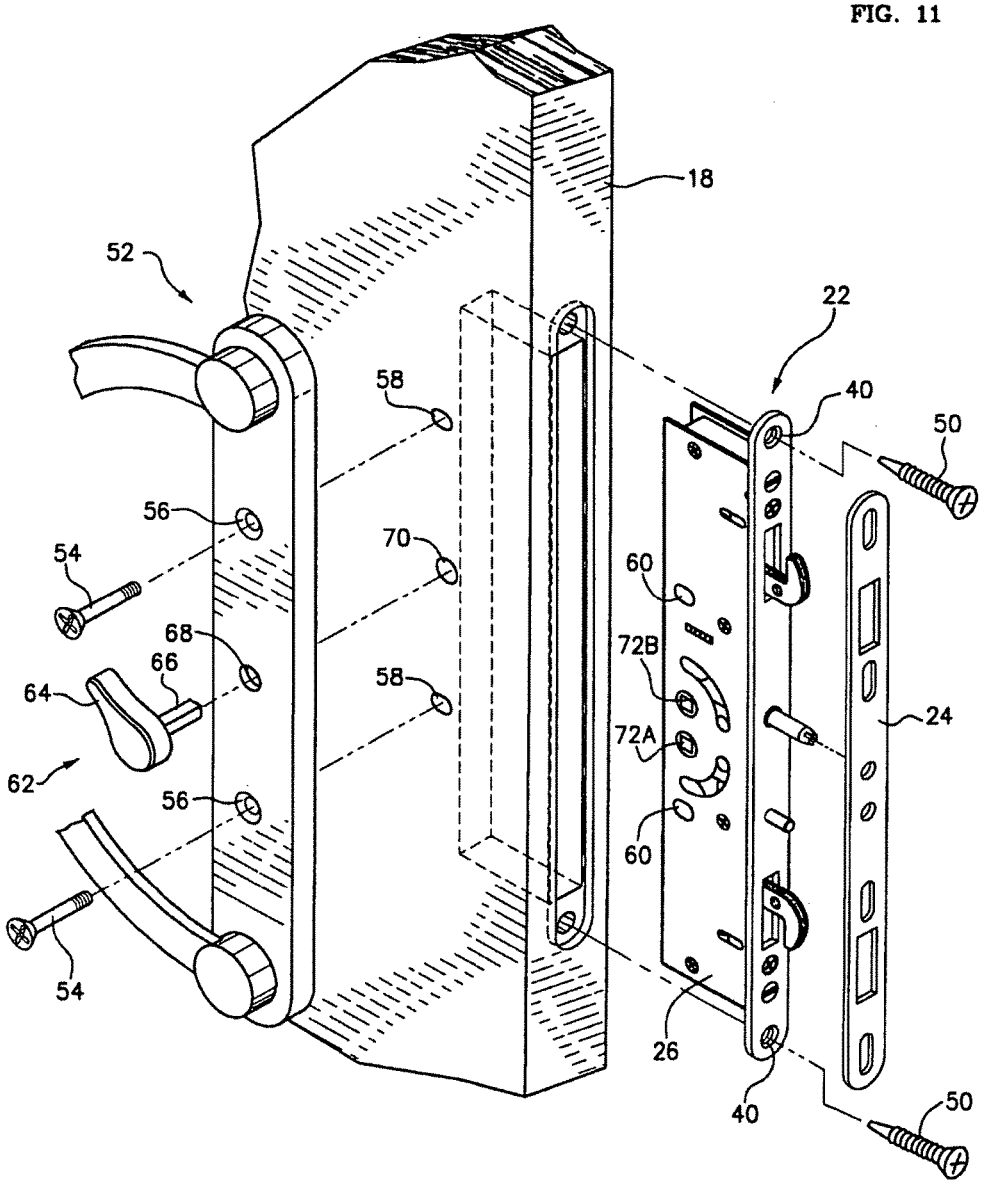
FIG. 11 is a perspective view showing a typical installation of one embodiment of the invention.

FIG. 11 shows a typical arrangement for mounting latch 22 within an opening of stile 18. Keeper plate 24 is mounted opposite latch 22 on jamb 20 (FIG. 1). Screws 50 pass through holes 40 and secure latch 22 within the opening in the face of stile 18. Door handle 52 is secured to the side of stile 18 by fasteners 54. Fasteners 54 may be screws, bolts or the like and may pass through the entire stile 18 via holes 56 in handle 52, holes 58 in stile 18 and holes 60 in outer casing 26 of latch 22. Thumb lever 62 comprises a lever portion 64 and a tail portion 66. Tail portion 66 passes through hole 68 in handle 52 and hole 70 in stile 18 to engage receiver 72A or 72B of actuator 74A or 74B, respectively (FIG. 8).

As shown in FIGS. 2 through 5, the latch comprises an outer casing 26, a faceplate 28, a centering peg 30, an upper hook 32, a lower hook 34 and a safety plunger 36. The faceplate 28 is held to the outer casing 26 by screws 38. Faceplate 28 is provided with holes 40 for attaching the latch to stile 18. As explained below in further detail, screws 42 allow the adjustment of the extent to which hooks 32 and 34 protrude from the surface of faceplate 28.

The description of hooks 32 and 34 will be made with particular reference to hook 32, however, hooks 32 and 34 are essentially identical except that they are mirror images of each other. As shown in FIGS. 7 and 10, hook 32 has a laminate construction. With reference to FIG. 6, hook 32 has hook portion 32*a*, sliding arm portion 32*b*, body portion 32*c* and receiver portion 32*d*. Sliding arm portion 32*b* defines indentations 44 and 46 which will be explained further below. Body portion 32*c* defines aperture 48 which also will be explained further below.

Figure 12:
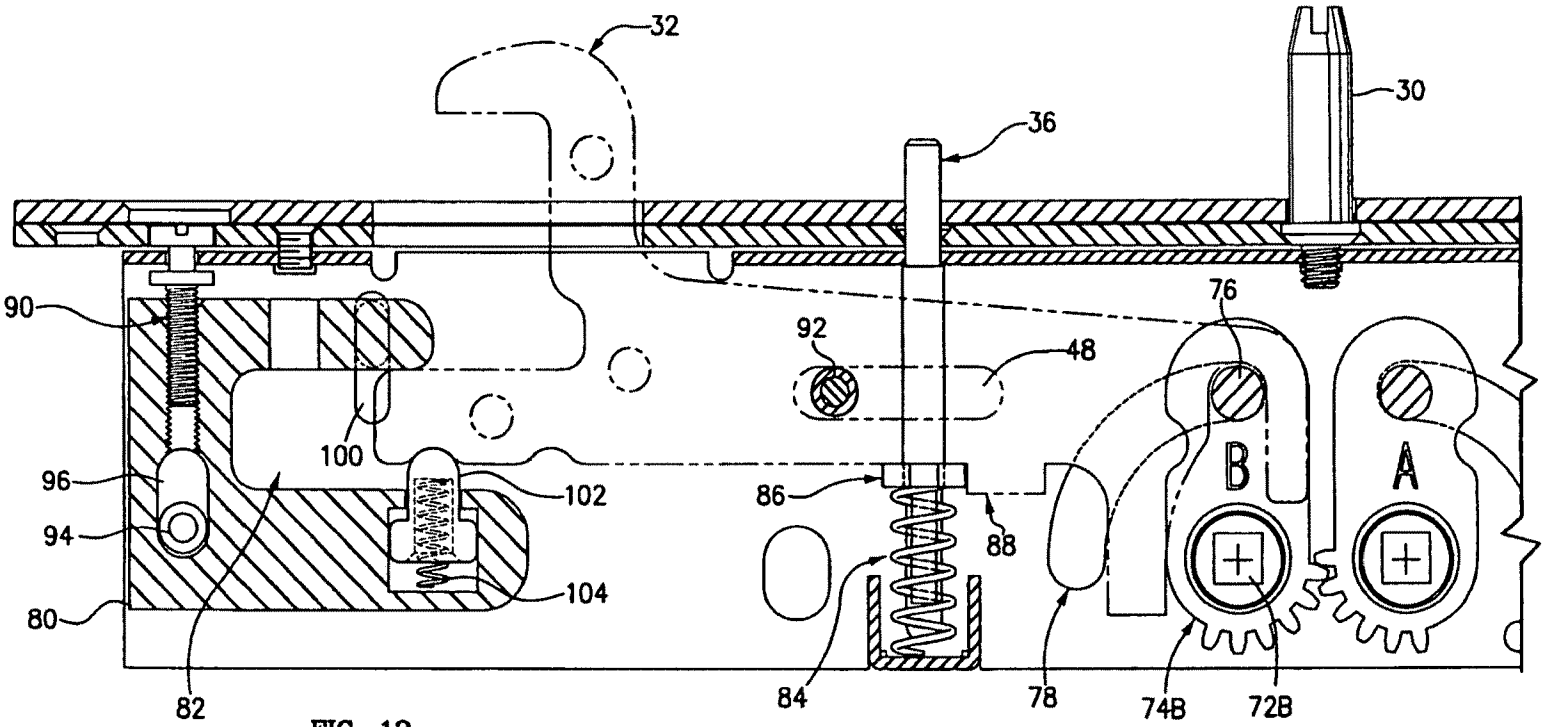
FIG. 12 is a side cut-away view of a portion of one embodiment of the invention showing the latch in an unlocked position with the hook somewhat extended away from the surface of the latch.
Figure 13:
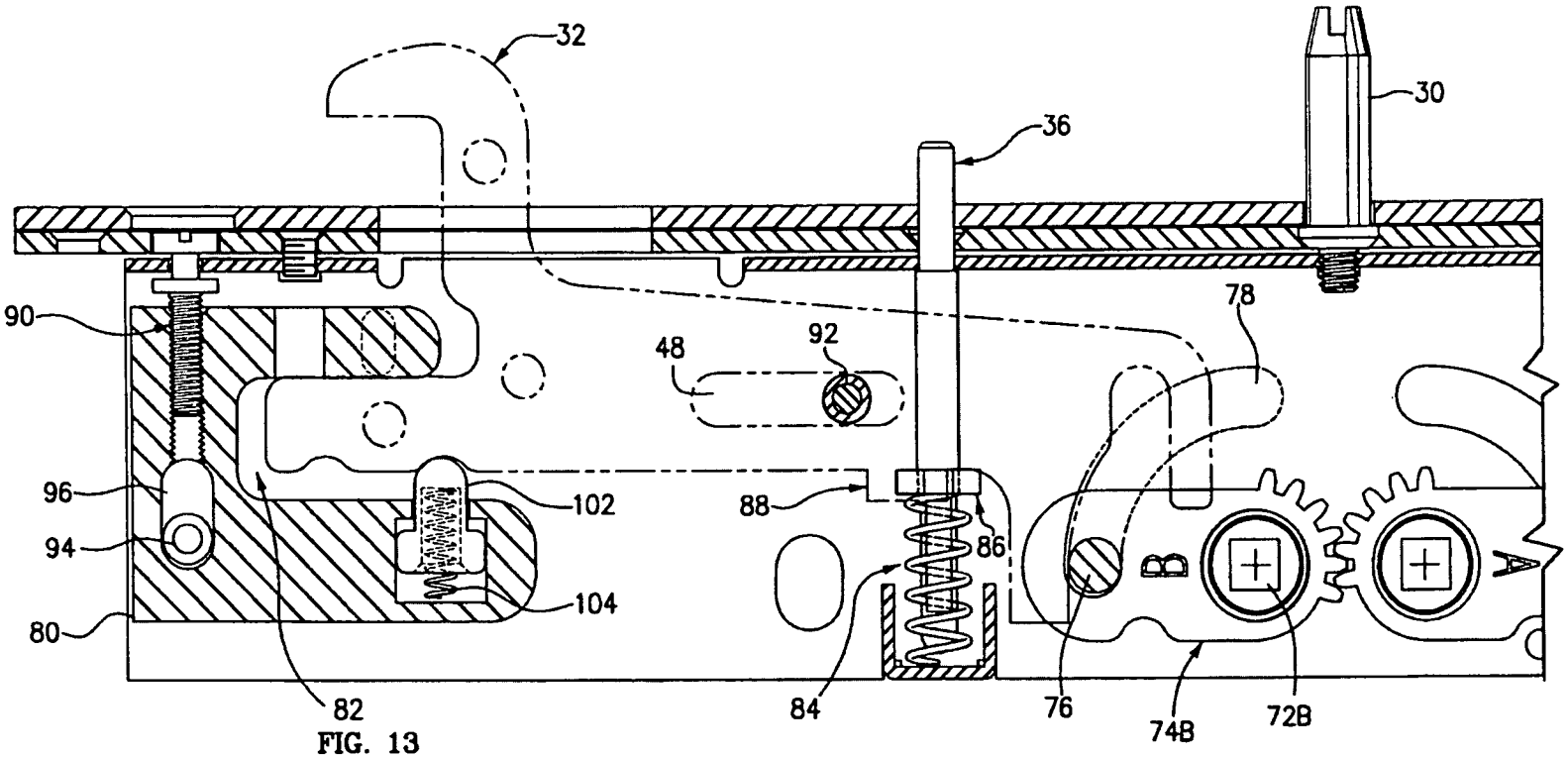
FIG. 13 is a side cut-away view of a portion of one embodiment of the invention showing the latch in a locked position with the hook somewhat extended away from the surface of the latch.

FIGS. 12 and 13 show how the various components of the latch interact to move hook 32 between an unlatched state (FIG. 12) and a latched state (FIG. 13). As shown, FIGS. 12 and 13 show primarily the upper portion of latch 22, however, the following descriptions of the upper portion apply equally to the identical components in the lower portion of lock 22. Beginning with the unlatched state shown in FIG. 12, a user rotates tail portion 66 via lever portion 64 (FIG. 11). Tail portion 66 is engaged in receiver 72*a* or 72*b* of actuator 74*a* or 74*b*. Peg 76 is engaged with actuator 74*b* and travels in raceway 78 of outer casing 26. Peg 76 is also contained within receiver portion 32*d* (FIG. 6) of hook 32. As shown in FIGS. 12 and 13, as actuator 74*b* rotates, peg 76 travels along raceway 78 and exerts lateral force against receiver portion 32*d* of hook 32 causing hook 32 to slide from the open position shown in FIG. 12 to the latched position shown in FIG. 13 in a generally linear motion that is generally parallel with faceplate 28. During such latching, sliding arm portion 32*b* of hook 32 slides laterally with respect to reinforcement block 80. Peg 92 within raceway 48 also serves to hold hook 32 in the correct position. Nub 102 and spring 104 act against sliding arm portion 32*b* of hook 32 and bias it upwards against reinforcement block 80. In the unlatched position the tip of nub 102 rests within indentation 44 and in the latched position the tip of nub 102 rests within indentation 46.

In the fully latched position, shown in FIG. 13, sliding arm portion 32*b* of hook 32 extends within cavity 82 of reinforcement block 80. Such an arrangement provides a much stronger link between the latch 22 and keeper plate 24 than is typical with latches with rotary hooks. The prototype of one embodiment of the invention is capable of withstanding more than 1,500 lbs/foot of force.

Figure 14:
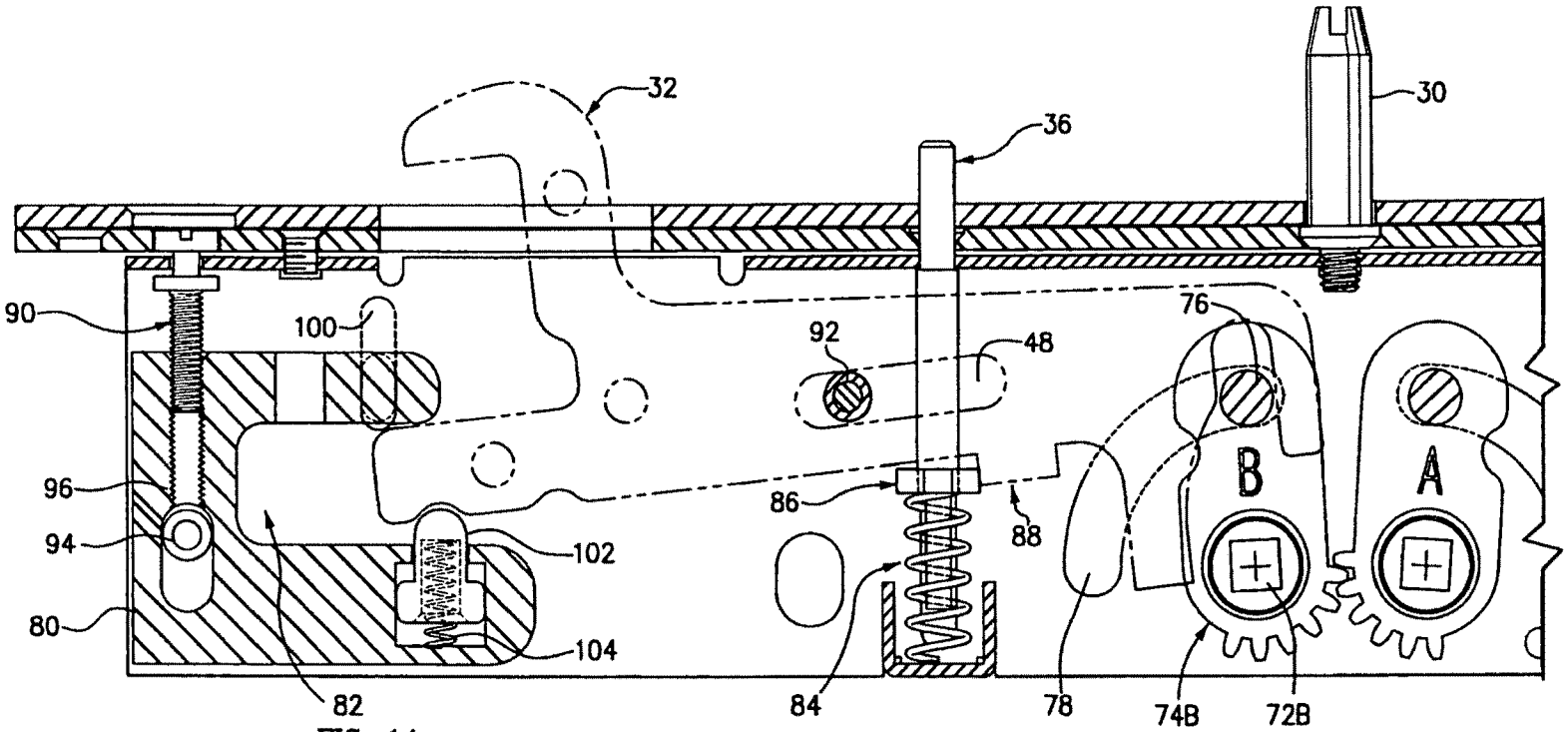
FIG. 14 is a side cut-away view of a portion of one embodiment of the invention showing the latch in an unlocked position with the hook somewhat retracted into the latch.
Figure 15:
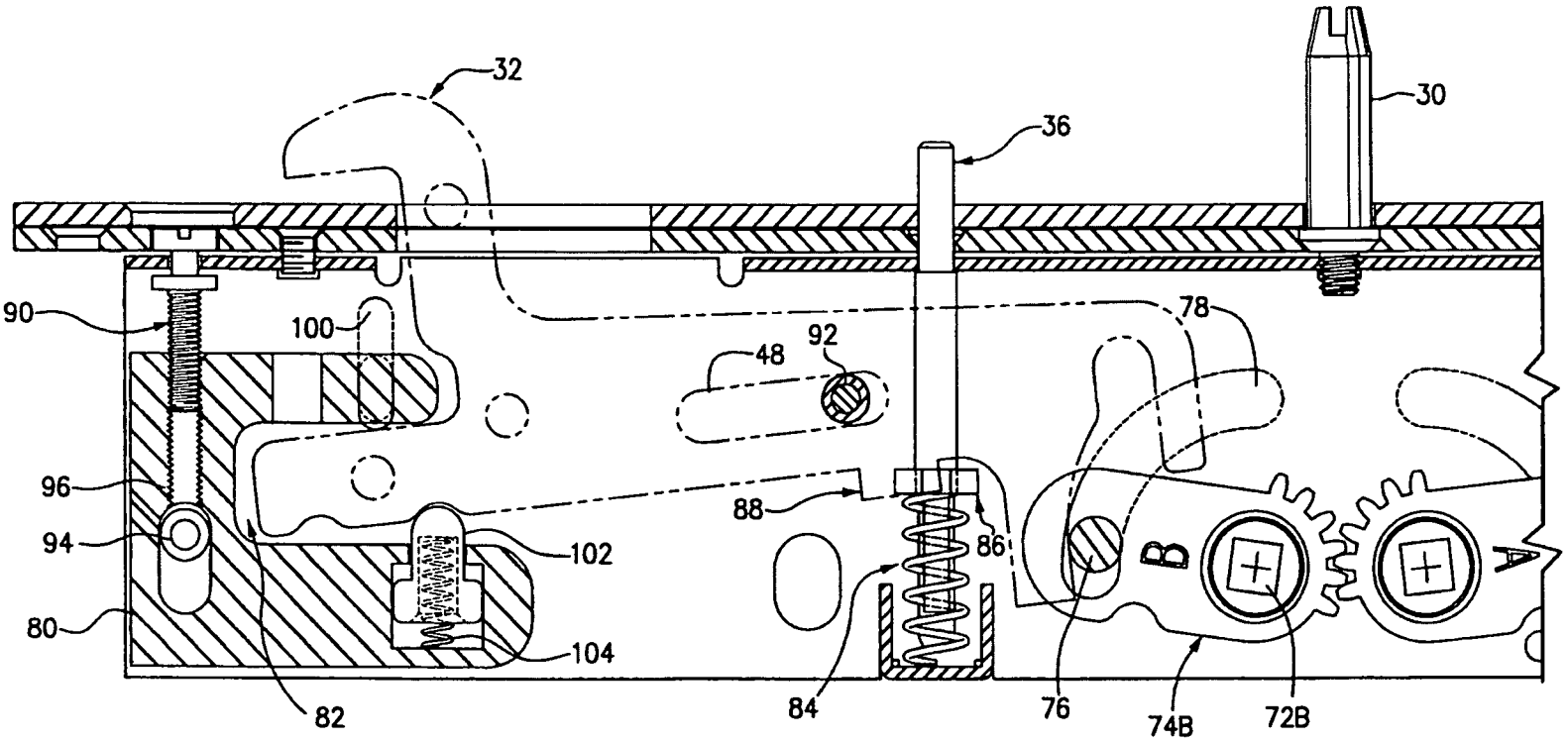
FIG. 15 is a side cut-away view of a portion of one embodiment of the invention showing the latch in a locked position with the hook somewhat retracted into the latch.

Reinforcement block 80 is held in position by screw 90, peg 94 within raceway 96 and tab 98 (FIG. 10) within raceway 100. Screw 90 in combination with reinforcement block 80 provide a means for adjusting the extent to which hooks 32 and 34 protrude from the surface of latch 22 to accommodate different thicknesses of keeper plate 24. By rotation of screw 90, reinforcement block 80 is moved closer (as shown in FIGS. 12 and 13) or further away (as shown in FIGS. 14 and 15) from the surface of latch 22 which, in turn, extends or retracts hook 32 with respect to the surface of latch 22.

As shown in FIG. 8, actuators 74*a* and 74*b* are provided with gearing 102*a* and 102*b* that act together. Thus, rotating either actuator 74*a* or actuator 74*b* results in the rotation of the other actuator as well which, in turn, causes the associated hook, 32 or 34 to move to the latched or unlatched position as explained above.

Safety plunger 36 is designed to prevent an operator of the latch from locking the latch unless the door 16 (FIG. 1) is closed. When door 16 is open, spring 84 biases annular flange 86 against body portion 32*c* of hook 32. Flange 86 and tab 88 of hook 32 prevent hook 32 from being moved laterally to a locked position. When door 16 is closed, safety plunger 36 is depressed by jam 20 which in turn depresses flange 86 enough to allow tab 88 to pass thus allowing hook 32 to be moved laterally. In this manner, safety plunger 36 prevents an operator of the latch from operating the latch, and therefore believing door 16 to be locked, without engaging hooks 32 and 34 with keeper plate 24.

The foregoing description is of a preferred embodiment of the invention. Various changes, modifications or substitutions may be made in the disclosed embodiment without departing from the scope or spirit of the invention.

I claim:

1. A door latch comprising:

a housing having a front face, a first side panel, and a second side panel opposite said first side panel;

wherein said front face does not comprise said first side panel or said second side panel and neither said first side panel nor said second side panel comprise said front face;

said front face defining an upper opening and a lower opening;

an upper hook assembly contained within said housing;

said upper hook assembly having a hook portion and a receiver portion;

said hook portion extending through said upper opening to allow engagement with a keeper plate;

said receiver portion of said upper hook assembly engaging an upper actuator mounted within said housing;

said upper actuator co-acting with said receiver portion of said upper hook assembly to slide said hook portion of said upper hook assembly in a generally linear motion, generally parallel with said front face of said housing between an unlatched position and a latched position;

a lower hook assembly contained within said housing;

said lower hook assembly having a hook portion and a receiver portion;

said hook portion extending through said lower opening to allow engagement with said keeper plate;

said receiver portion of said lower hook assembly engaging a lower actuator mounted within said housing;

said lower actuator co-acting with said receiver portion of said lower hook assembly to slide said hook portion of said lower hook assembly in a generally linear motion, generally parallel with said front face of said housing between an unlatched position and a latched position;

said upper and lower actuators provided with means for co-action such that activation of one actuator results in activation of the other actuator;

wherein said hook assemblies further comprise sliding arm portions and said door latch further comprises reinforcement blocks within said housing;

said reinforcement blocks defining internal cavities;

said sliding arm portions of said hook assemblies extending into said internal cavities of said reinforcement blocks when said hook assemblies are in the latched positions;

wherein each of said reinforcement blocks defines a threaded hole, second holes in approximate axial alignment with said threaded holes are defined by said front face of said housing and a threaded member passes through each of said second holes and engages the threads of said threaded holes whereby rotation of said threaded member adjusts the position of said reinforcement blocks with respect to said front face of said housing.

2. The door latch of claim 1 further comprising a safety plunger extending approximately perpendicularly through said front face and traveling between an extended and compressed position;

said safety plunger biased toward the extended position; and said safety plunger co-acting with one of said hook assemblies to prevent said hook assemblies from moving to the latched position when said safety plunger is in the extended position and allow said hook assemblies to be moved to the latched position when said safety plunger is in the compressed position.

* * * * *